US011717927B2

(12) United States Patent
Suzuki

(10) Patent No.: US 11,717,927 B2
(45) Date of Patent: Aug. 8, 2023

(54) WORKPIECE GRINDING METHOD

(71) Applicant: DISCO CORPORATION, Tokyo (JP)

(72) Inventor: Yoshikazu Suzuki, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 2 days.

(21) Appl. No.: 17/659,268

(22) Filed: Apr. 14, 2022

(65) Prior Publication Data

US 2022/0362900 A1 Nov. 17, 2022

(30) Foreign Application Priority Data

May 14, 2021 (JP) ..... 2021-082393

(51) Int. Cl.
*B24B 1/00* (2006.01)
*B24B 7/22* (2006.01)
*B24B 7/04* (2006.01)

(52) U.S. Cl.
CPC ..... *B24B 1/00* (2013.01); *B24B 7/04* (2013.01); *B24B 7/228* (2013.01)

(58) Field of Classification Search
CPC .. B24B 1/00; B24B 7/04; B24B 7/228; B24B 1/04; B24B 7/22; B24B 5/01; B24B 37/042; B24B 37/10; B24B 37/04
USPC ..... 451/28, 41, 283
See application file for complete search history.

(56) References Cited

U.S. PATENT DOCUMENTS 11,590,630 B2 * 2/2023 Suzuki ..... B24B 27/0046
2008/0090505 A1 * 4/2008 Yoshida ..... B24B 7/228 451/413

FOREIGN PATENT DOCUMENTS

JP 2007019461 A 1/2007

* cited by examiner

*Primary Examiner* — Orlando E Aviles
*Assistant Examiner* — Abbie E Quann
(74) *Attorney, Agent, or Firm* — Greer Burns & Crain Ltd.

(57) ABSTRACT

A workpiece has a device area and a peripheral area surrounding the device area on a front surface side thereof. A workpiece grinding method includes a groove forming step of performing grinding feed of a grinding unit while a spindle is rotated, and grinding a predetermined area on a back surface side of the workpiece, the predetermined area corresponding to the device area, in a state in which a chuck table holding the workpiece is not rotated, thereby forming a groove on the back surface side, a groove removing step of starting rotation of the chuck table while the spindle is kept rotating, thereby grinding side walls of the groove and removing the groove, and a recess forming step of performing grinding feed of the grinding unit while the spindle and the chuck table are rotated, thereby grinding the predetermined area and forming a recess and a ring-shaped reinforcement part.

2 Claims, 9 Drawing Sheets

WORKPIECE GRINDING METHOD

BACKGROUND OF THE INVENTION

Field of the Invention

The present invention relates to a workpiece grinding method of grinding a predetermined area on a back surface side of a workpiece having, on a front surface side thereof, a device area and a peripheral marginal area surrounding the device area, the predetermined area corresponding to the device area, to form a disk-shaped recess and a ring-shaped reinforcement part surrounding the recess.

Description of the Related Art

To lighten and thin device chips to be mounted on electronic apparatuses, a wafer (workpiece) formed with a plurality of devices on a front surface may be ground by a grinding apparatus to thin the workpiece to, for example, 100 μm or less. However, when the workpiece is thinned too much, it is not easy to convey the workpiece that has been thinned. In view of this, there has been known a grinding method of grinding a predetermined area on a back surface side of a workpiece, the predetermined area corresponding to a device area which is present on a front surface side of the wafer and where a plurality of devices are formed, to form a disk-shaped recess and a ring-shaped reinforcement part surrounding the recess (see, for example, Japanese Patent Laid-open No. 2007-19461).

This grinding method is called TAIKO (registered trademark in Japan, United States of America, Republic of Singapore, etc.). When the ring-shaped reinforcement part is formed at a peripheral portion of the workpiece, a warp of the workpiece can be reduced as compared to the workpiece uniformly thinned on the back surface side, and further, strength of the workpiece is enhanced. In addition, cracking of the workpiece with the peripheral portion of the workpiece as a starting point can be restrained. To form the ring-shaped reinforcement part, a grinding wheel having an outside diameter smaller than the outside diameter of the workpiece is used. The grinding wheel has an annular wheel base, and on one surface side of the wheel base, a plurality of grindstones each being segment-shaped are fixed along the circumferential direction of the wheel base.

The grinding wheel is smaller in diameter than a normal grinding wheel used for uniformly grinding the whole of the back surface side, and has a small number of grindstones compared to the normal grinding wheel. Further, the peripheral speed at the time of grinding by the above-described grinding wheel is slower than the peripheral speed at the time of grinding by the normal grinding wheel, so that the work amount per grindstone of the above-described grinding wheel is increased as compared to the work amount per grindstone of the normal grinding wheel. Therefore, since grinding capability of the grindstone of the above-described grinding wheel is liable to be lowered as compared to the grindstone of the normal grinding wheel, a poor state of the grindstone, such as dulling, shedding, and clogging is liable to occur. For example, in a case where a comparatively hard oxide film is formed on the back surface side of the workpiece, grinding faults attendant on lowering in grinding capability are liable to occur.

SUMMARY OF THE INVENTION

The present invention has been made in consideration of such problems. It is an object of the present invention to provide a grinding method capable of restraining occurrence of grinding faults in grinding for forming a ring-shaped reinforcement part on a back surface side of a workpiece.

In accordance with an aspect of the present invention, there is provided a workpiece grinding method of grinding a workpiece by use of a grinding apparatus. The grinding apparatus includes a chuck table that holds the workpiece and a grinding unit that includes a spindle and, in a state in which a grinding wheel having a plurality of grindstones disposed in an annular pattern is mounted to the spindle and is rotated around the spindle, grinds the workpiece held on the chuck table. The workpiece has, on a front surface side thereof, a device area in which a plurality of devices are formed and a peripheral marginal area surrounding the device area. In the grinding method, a predetermined area on a back surface side of the workpiece, the predetermined area corresponding to the device area, is ground by the grinding wheel and a disk-shaped recess and a ring-shaped reinforcement part surrounding the recess are formed. The grinding method includes a groove forming step of performing grinding feed of the grinding unit while the spindle is rotated, and grinding the predetermined area, in a state in which the chuck table holding the workpiece is not rotated, thereby forming an arcuate or annular groove having a depth not reaching a finished thickness on the back surface side of the workpiece, a groove removing step of starting rotation of the chuck table while the spindle is kept rotating, thereby grinding side walls of the groove and removing the groove from the workpiece, after the groove forming step, and a recess forming step of performing grinding feed of the grinding unit while the spindle and the chuck table are rotated, thereby grinding the predetermined area that corresponds to the device area and forming the recess and the ring-shaped reinforcement part surrounding the recess, after the groove removing step.

Preferably, in the groove removing step, the chuck table is rotated while grinding feed of the grinding unit is performed.

In the workpiece grinding method according to the aspect of the present invention, grinding feed of the grinding unit is performed while the spindle is rotated, and the workpiece is ground, in a state in which the chuck table holding the workpiece is not rotated, to thereby form an arcuate or annular groove having a depth not reaching the finish thickness on the back surface of the workpiece (groove forming step). After the groove forming step, rotation of the chuck table is started while the spindle is kept rotating, to thereby grind side walls of the groove and remove the groove from the workpiece (groove removing step).

Further, after the groove removing step, grinding feed of the grinding unit is performed while the spindle and the chuck table are rotated, to thereby grind a predetermined area corresponding the device area and form a recess and the ring-shaped reinforcement part surrounding the recess (recess forming step). In the groove forming step, grinding is conducted mainly by the bottom surfaces of the grindstones, but in the groove removing step, grinding can be performed mainly by the side surfaces of the grindstones. Therefore, in the groove removing step, as compared to the case of mainly grinding the whole of the back surface side of the workpiece by the bottom surfaces of the grindstones, worsening of condition of the bottom surfaces of the grindstones (that is, lowering in grinding capability) can be reduced.

Then, in the recess forming step after the groove removing step, the whole of the predetermined area of the back surface side of the workpiece from which the groove has been removed is ground. In the recess forming step, grinding is conducted mainly by the bottom surfaces of the grindstones, and, particularly, grinding can be conducted in a state in which the degree of worsening of condition of the bottom surfaces of the grindstones is lowered. Therefore, even in a case where a comparatively hard oxide film is formed on the back surface side of the workpiece, occurrence of grinding faults of the workpiece can be restrained.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
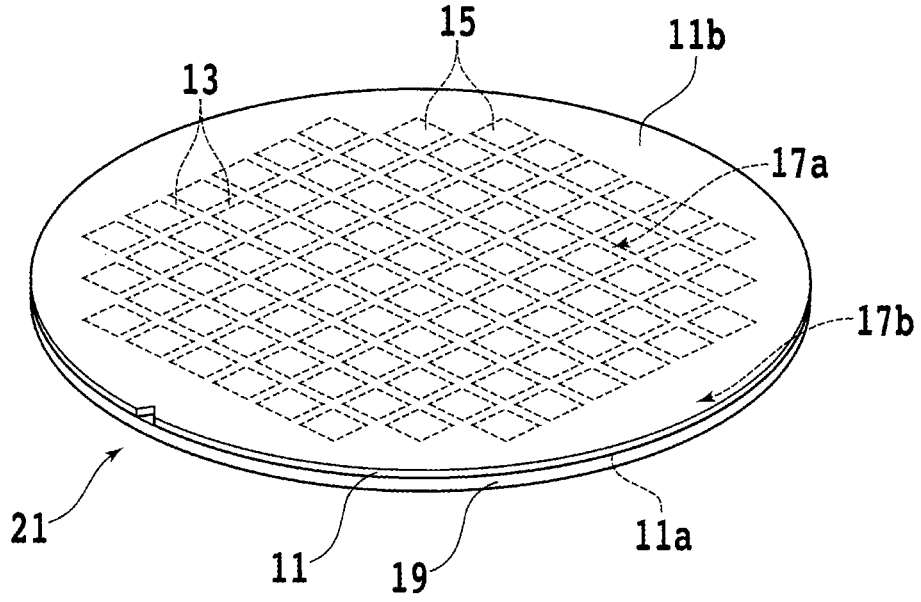
FIG. 1 is a perspective view of a workpiece.

Embodiments according to an aspect of the present invention will be described with reference to the attached drawings. First, with reference to FIG. 1, a workpiece 11 as an object of grinding in a first embodiment will be described. FIG. 1 is a perspective view of the workpiece 11 and the like. The workpiece 11 of the present embodiment is a disk-shaped silicon wafer having a predetermined diameter (for example, approximately 200 mm). The workpiece 11 has a front surface 11*a* and a back surface 11*b*, and the length from the front surface 11*a* to the back surface 11*b* (that is, the thickness of the workpiece 11) is a predetermined value (for example, 725 μm) in the range of 200 μm to 800 μm.

On the whole of the back surface 11*b*, a thermal oxide film (not illustrated) having a thickness on the order of 2,000 Å to 3,000 Å is formed. On the front surface 11*a*, a plurality of projected dicing lines (streets) 13 are set in a grid pattern. On the front surface 11*a* side of rectangular areas partitioned by the plurality of streets 13, devices 15 such as integrated circuits (ICs) are formed. Note that there are no limitations on the kind, material, size, shape, structure, and the like of the workpiece 11. The workpiece 11 may be a wafer or a substrate of a compound semiconductor (GaN, SiC, etc.) other than silicon, glass, ceramic, resin, metal, or the like. In addition, there are no limitations on the kind, number, shape, structure, size, disposition, and the like of the devices 15 formed on the workpiece 11.

Around a device area 17*a*, in such a manner as to surround, in a plan view, the device area 17*a* where the plurality of devices 15 are formed, an annular peripheral marginal area 17*b* in which the devices 15 are not formed and which is substantially flat is present. Before the workpiece 11 is ground, for reducing damage to the devices 15 at the time of grinding, a resin-made circular protective tape 19 is attached to the front surface 11*a* side. As a result, a workpiece unit 21 in which the workpiece 11 and the protective tape 19 are laminated is formed.

Figure 8:
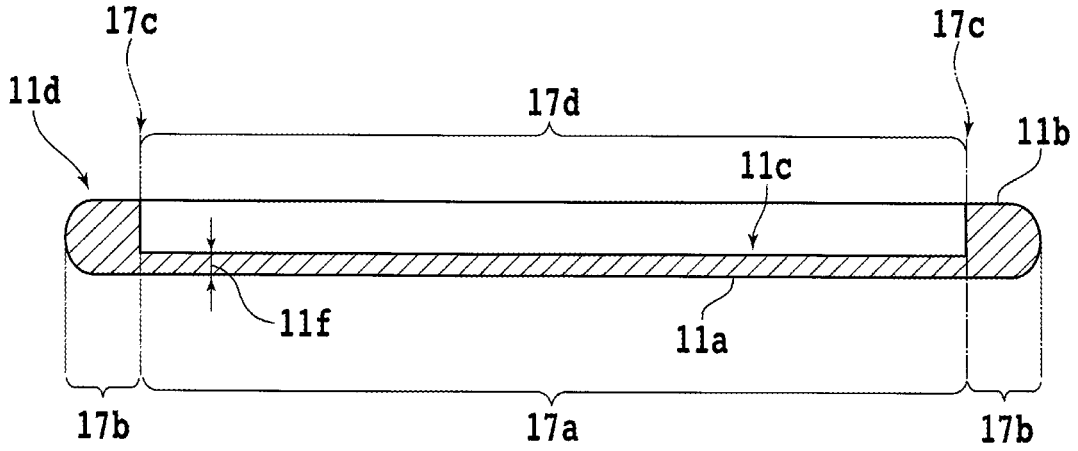
FIG. 8 is a sectional view of the workpiece that has undergone grinding.

At the time of grinding of the workpiece 11, a predetermined area 17*d* (see FIG. 8) on the back surface 11*b* side, the predetermined area 17*d* corresponding to the device area 17*a*, is ground by a predetermined depth. As a result, as depicted in FIG. 8, a disk-shaped recess 11*c* and a ring-shaped reinforcement part 11*d* surrounding a side part of the recess 11*c* are formed.

Figure 3:
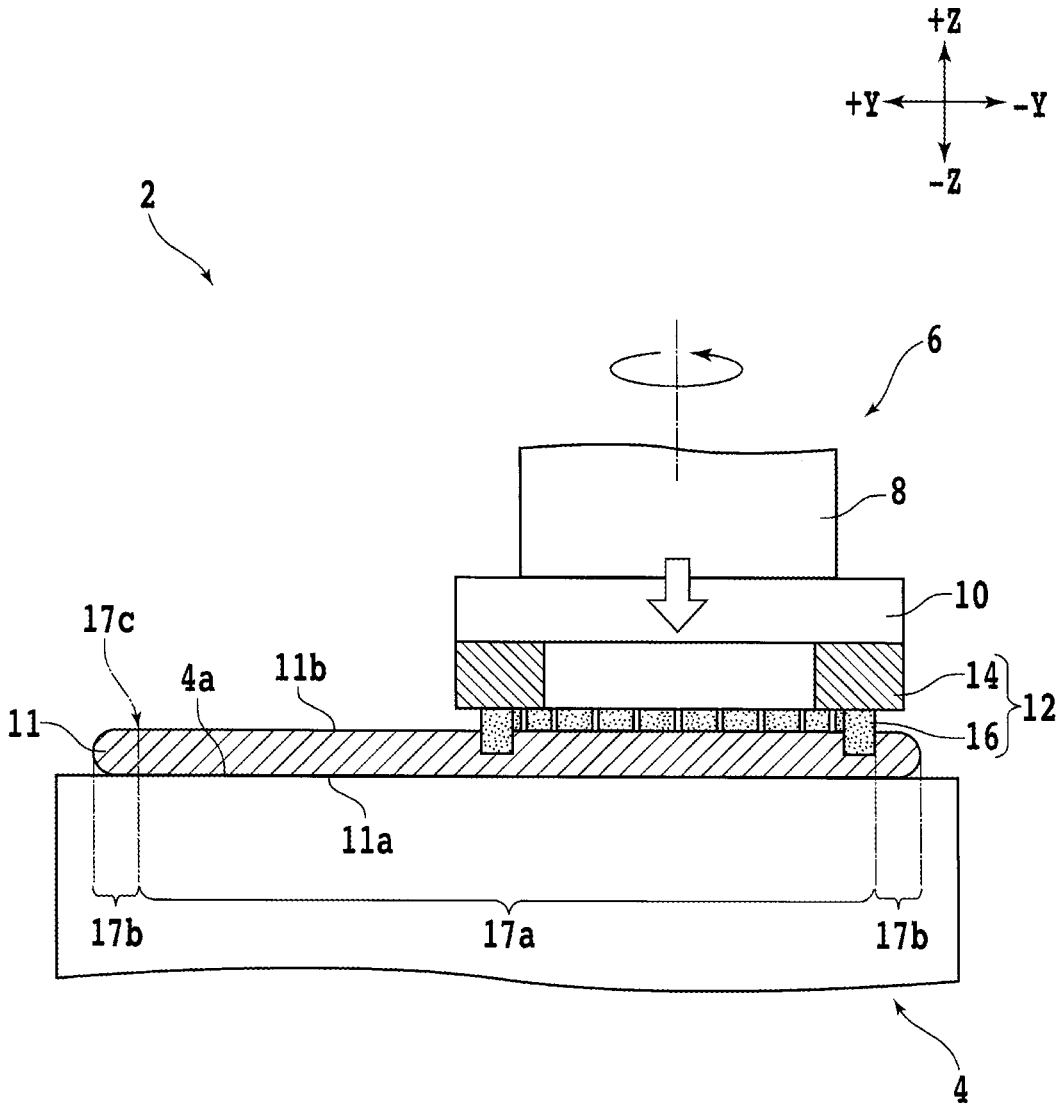
FIG. 3 is a partially sectional side view depicting a groove forming step.
Figure 4A:
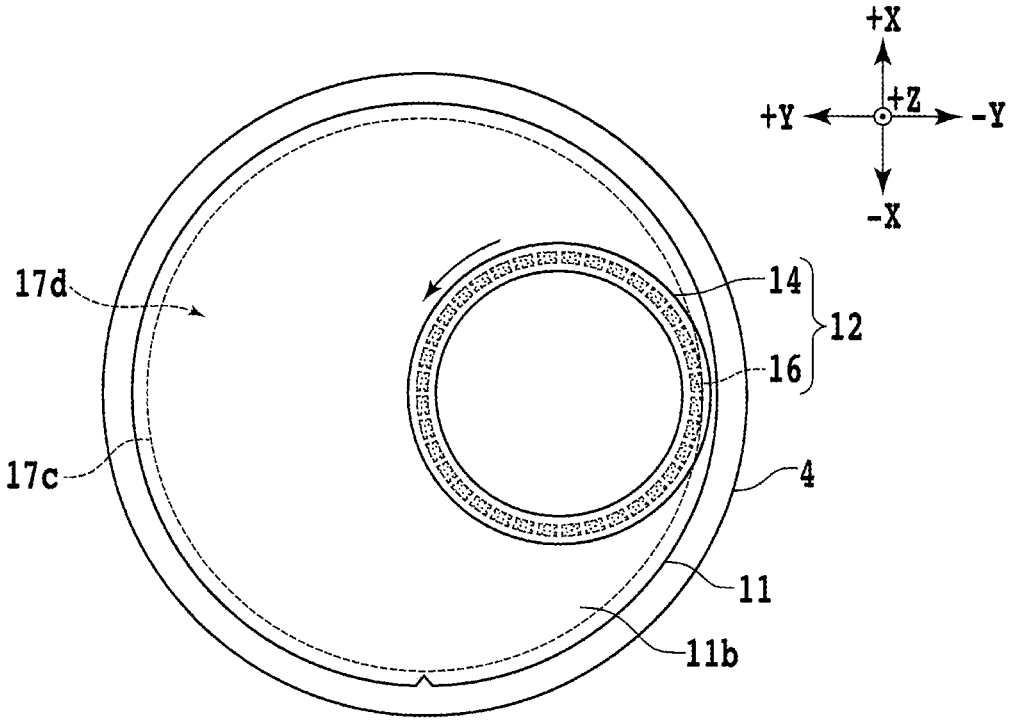
FIG. 4A is a top plan view of the workpiece and the like in the groove forming step.
Figure 4B:
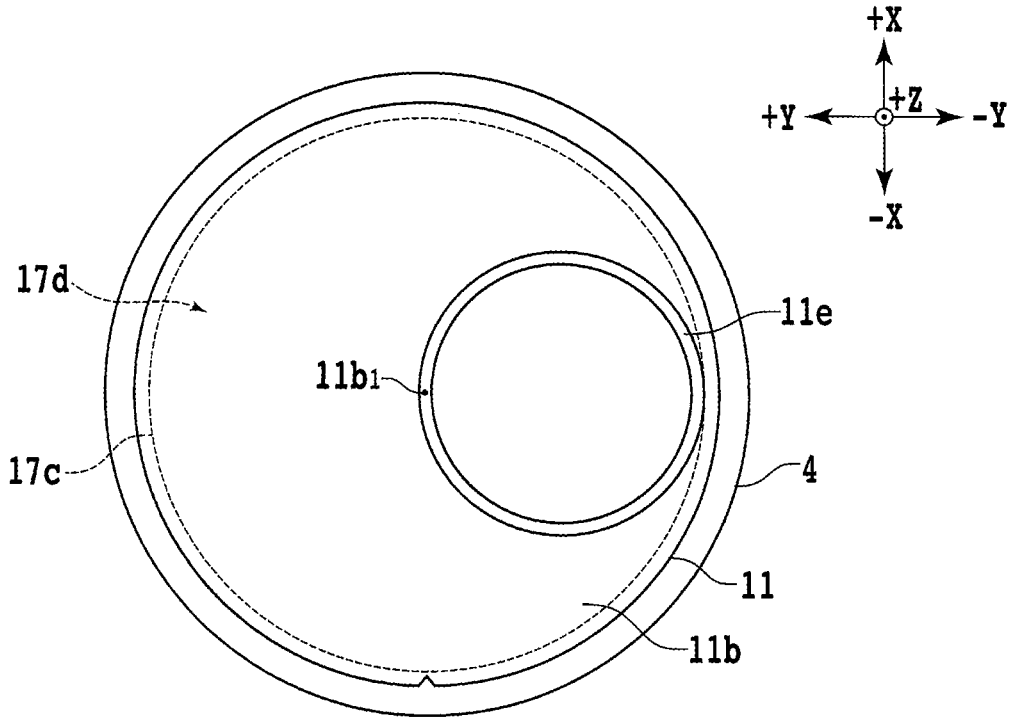
FIG. 4B is a top plan view of the workpiece depicting a groove formed in the groove forming step.

Next, with reference to FIG. 3, a grinding apparatus 2 used for grinding the workpiece 11 will be described. A +Z direction and a −Z direction depicted in FIG. 3 are mutually opposite directions parallel to the Z-axis direction. For example, the +Z direction is an upward direction, and the −Z direction is a downward direction. In addition, as depicted in FIGS. 3, 4A, and 4B, a +X direction and a −X direction are mutually opposite directions parallel to an X-axis direction orthogonal to the Z-axis direction, and a +Y direction and a −Y direction are mutually opposite directions parallel to a Y-axis direction orthogonal to the Z-axis direction and the X-axis direction. For example, an X-Y plane is parallel to a horizontal plane.

As depicted in FIG. 3, the grinding apparatus 2 includes a disk-shaped chuck table 4 that holds under suction the front surface 11*a* side of the workpiece 11. The chuck table 4 has a disk-shaped frame body formed of ceramic. In a central part of the frame body, there is formed a disk-shaped recess (not illustrated). Inside the frame body, a predetermined flow path (not illustrated) is formed. One end portion of the predetermined flow path is exposed to the recess, and the other end portion of the predetermined flow path is connected to a suction source (not illustrated) such as an ejector.

To the recess of the frame body, a porous plate (not illustrated) formed of a porous ceramic is fixed. A negative pressure from the suction source is transmitted to an upper surface of the porous plate. The upper surface of the porous plate and an upper surface of the frame body are flush, and function as a holding surface 4*a* that holds the workpiece 11 under suction. Note that an annular area between a peripheral end and a center of the holding surface 4*a* is recessed compared to the peripheral end and the center of the holding surface 4*a*, and the annular area as viewed in cross-section of the chuck table 4 in the radial direction of the holding surface 4*a* has what is generally called a double-recessed shape. It is to be noted, however, that the depth of the recess is, for example, on the order of from 1 μm to 20 μm, and therefore, for convenience' sake, the holding surface 4*a* is depicted to be substantially flat in FIG. 3. In the other drawings, also, the holding surface 4*a* is depicted substantially flat for convenience' sake.

The chuck table 4 is rotatable around a predetermined rotational axis 4*b* (see FIG. 5) by a rotational drive source (not illustrated) such as a motor provided at a lower portion thereof. The rotational axis 4*b* is inclined by a predetermined angle relative to the Z-axis direction in an X-Z plane such that a peripheral end portion on a +X direction side of the holding surface 4*a* is slightly higher than a peripheral end portion on a −X direction side of the holding surface 4*a*.

Returning to FIG. 3, other constituent elements of the grinding apparatus 2 will be described. A grinding unit 6 is disposed above the chuck table 4. The grinding unit 6 has a cylindrical spindle housing (not illustrated). To the spindle housing, a ball screw type grinding feed mechanism (not illustrated) that moves the grinding unit 6 along the Z-axis direction is connected. In the spindle housing, a part of a cylindrical spindle 8 is rotatably held.

The spindle 8 of the present embodiment is disposed substantially in parallel to the Z-axis direction. At an upper end portion of the spindle 8, a rotational drive source (not illustrated) such as a motor is provided, and at a lower end portion of the spindle 8, a disk-shaped mount 10 is fixed. On a lower surface side of the mount 10, an annular grinding wheel 12 is mounted. The grinding wheel 12 has an annular wheel base 14 formed of metal such as an aluminum alloy. An upper surface side of the wheel base 14 is fixed to a lower surface side of the mount 10.

The grinding wheel 12 mounted to the spindle 8 as described above can be rotated around the spindle 8. On a lower surface side of the wheel base 14, a plurality of grindstones 16 each segment-shaped are annularly disposed along the circumferential direction of the wheel base 14. Note that the outside diameter of an area formed by the locus of the plurality of grindstones 16 is roughly one half the diameter of the back surface 11*b*.

Figure 2:
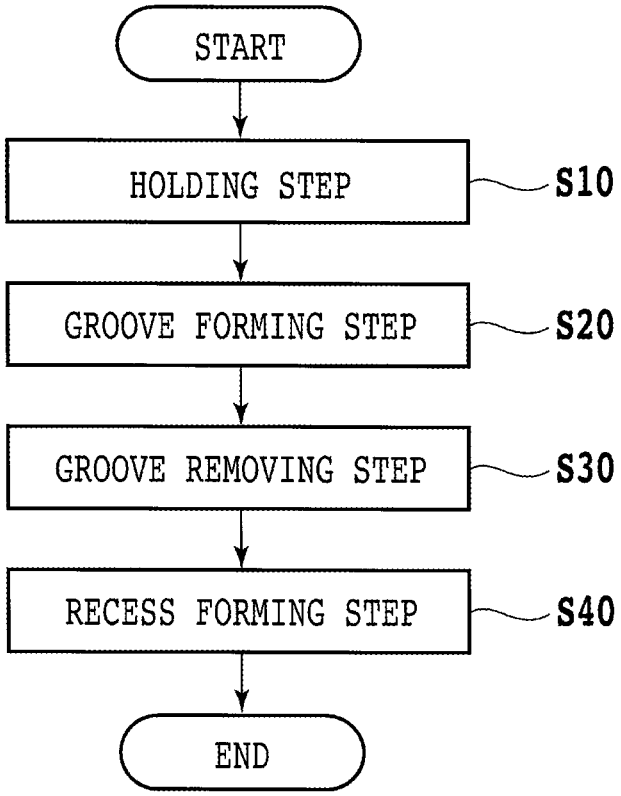
FIG. 2 is a flow chart of a grinding method.

Next, the grinding method of grinding the workpiece 11 by use of the grinding apparatus 2 will be described. FIG. 2 is a flow chart of the grinding method. First, as depicted in FIG. 3, the front surface 11*a* side of the workpiece 11 is held under suction on the holding surface 4*a* through the protective tape 19. In this instance, the workpiece 11 is deformed according to the shape of the holding surface 4*a* (holding step S10). After the holding step S10, a groove forming step S20 is performed.

In the groove forming step S20, in a state in which the chuck table 4 with the workpiece 11 held under suction thereon is not rotated (that is, is kept still), grinding feed of the grinding unit 6 is performed along the Z-axis direction, while the spindle 8 is rotated at a predetermined rotational speed. In the present embodiment, the predetermined rotational speed of the spindle 8 is 4,000 rpm, and the grinding feed speed is 3.0 μm/s. FIG. 3 is a partially sectional side view depicting the groove forming step S20. Note that in FIG. 3 and the subsequent drawings, the protective tape 19 is omitted for convenience' sake.

FIG. 4A is a top plan view of the workpiece 11 and the like in the groove forming step S20. In FIG. 4A, a boundary area 17*c* on the back surface 11*b* side, the boundary area 17*c* corresponding to the boundary between the device area 17*a* and the peripheral marginal area 17*b*, is indicated by a broken line. The inner side of the boundary area 17*c* is the above-described predetermined area 17*d*. In the groove forming step S20 of the present embodiment, an area of the predetermined area 17*d* on the back surface 11*b* side, the area corresponding to the moving locus of the grindstones 16, is ground, to form an annular groove 11*e* passing through a center $\mathbf{11}b_1$ of the back surface 11*b*. FIG. 4B is a top plan view of the workpiece 11 depicting the groove 11*e* formed in the groove forming step S20.

The groove 11*e* formed in the groove forming step S20 is deeper than the thickness of the oxide film formed on the back surface 11*b* side and has a predetermined depth not reaching a finish thickness 11*f* (see FIG. 8) of the device area 17*a*. For example, the oxide film is 0.2 μm to 0.3 μm. In a case where the grinding feed speed is 3.0 μm/s, when grinding is conducted for one second from the first contact of the lower surfaces of the grindstones 16 with the back surface 11*b*, the grindstones 16 break through the oxide film, and a groove 11*e* of which the depth to the deepest bottom part is 3.0 μm is formed. Note that the depth of the groove 11*e* does not reach the finish thickness 11*f*, since the thickness of the workpiece 11 before the groove forming step S20 is more than or equal to 200 μm and the finish thickness 11*f* is, for example, 100 μm.

Figure 5:
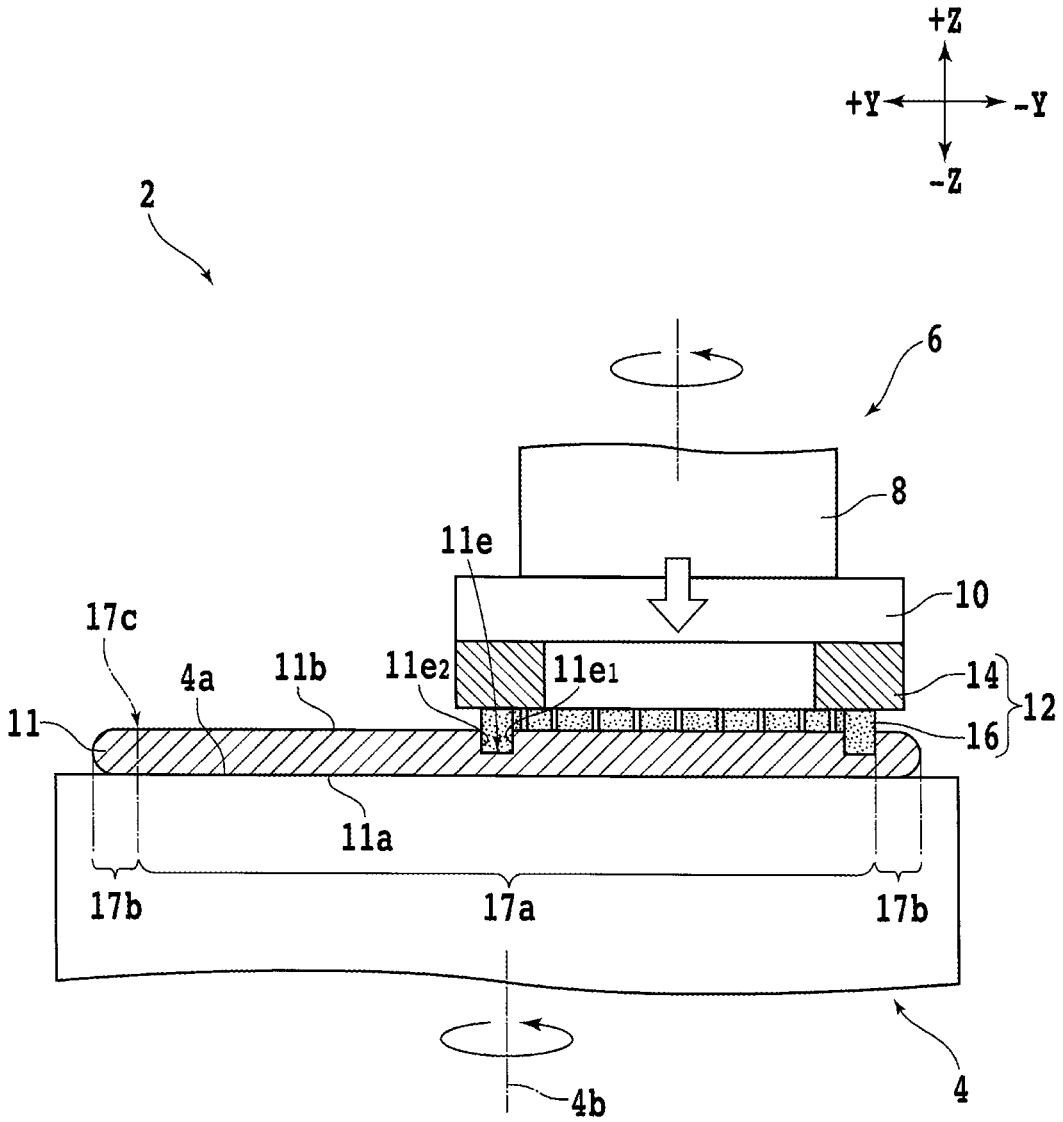
FIG. 5 is a partially sectional side view depicting a groove removing step.
Figure 6:
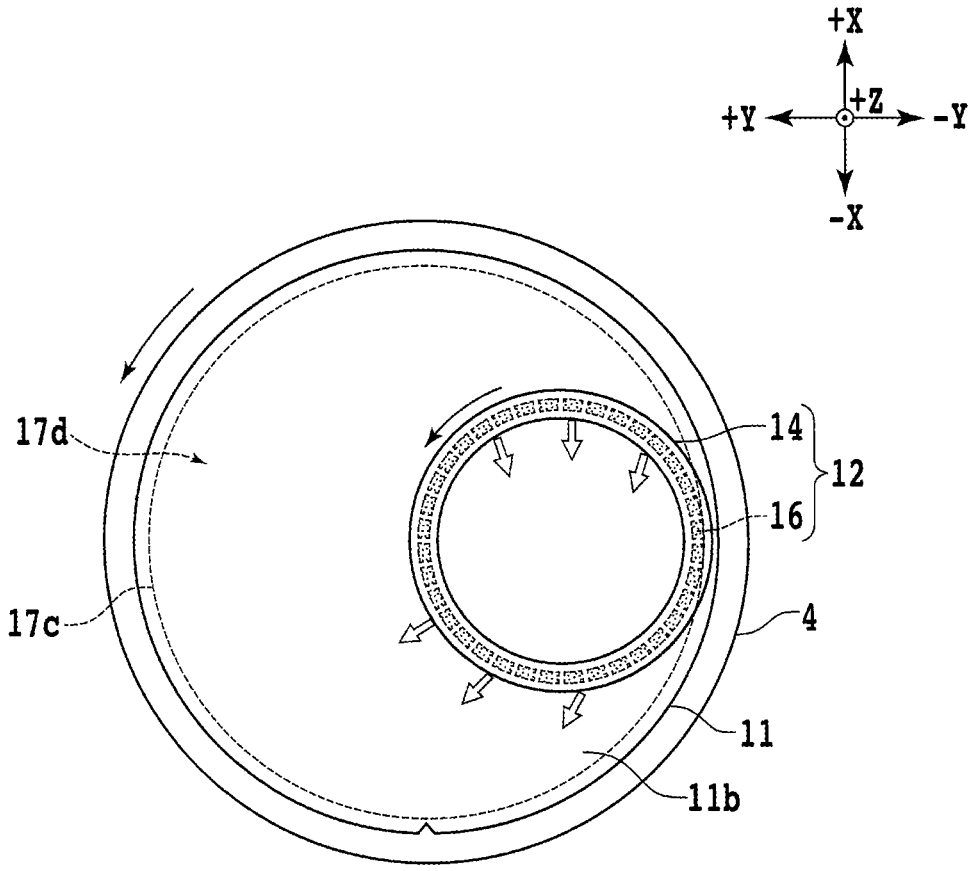
FIG. 6 is a top plan view of the workpiece and the like in the groove removing step.

After the groove forming step S20, rotation of the chuck table 4 is started while the spindle 8 is rotated at a predetermined rotational speed (groove removing step S30). In the groove removing step S30, as depicted in FIGS. 5 and 6, an inner circumferential side wall $\mathbf{11}e_1$ and an outer circumferential side wall $\mathbf{11}e_2$ of the groove 11*e* are ground, whereby the groove 11*e* is removed from the workpiece 11. In the groove removing step S30, for example, rotation of the chuck table 4 is started, and the rotational speed of the chuck table 4 is finally set to 300 rpm. In the groove removing step S30 of the present embodiment, the chuck table 4 is rotated while grinding feed of the grinding unit 6 is performed downwardly at a speed of 3.0 μm/s, but the chuck table 4 may be rotated without grinding feed being performed.

FIG. 5 is a partially sectional side view depicting the groove removing step S30, and FIG. 6 is a top plan view of the workpiece 11 and the like in the groove removing step S30. In FIG. 6, the manner of grinding the inner circumferential side wall $\mathbf{11}e_1$ and the outer circumferential side wall $\mathbf{11}e_2$ of the groove 11*e* is schematically depicted by an arrow. In the groove forming step S20, grinding is mainly conducted by bottom surfaces of the grindstones 16, whereas in the groove removing step S30, grinding can mainly be performed by side surfaces (inner circumferential side surface and outer circumferential side surface) of the grindstones 16.

Therefore, in the groove removing step S30, as compared to the case of grinding the whole of the back surface 11*b* side mainly by the bottom surfaces of the grindstones 16, worsening of the condition of the bottom surfaces of the grindstones 16 (that is, lowering in grinding capability) can be reduced. In addition, in the present embodiment, the groove removing step S30 is performed, and the predetermined area 17*d* can thereby be ground by use of both the inner circumferential side surfaces and the outer circumferential side surfaces of the grindstones 16. Therefore, a load to the side surfaces of the grindstones 16 can be reduced as compared to the case of grinding by use of only one of the inner circumferential side surfaces and the outer circumferential side surfaces of the grindstones 16 in the groove removing step S30.

After the groove removing step S30, continuously, grinding feed of the grinding unit 6 is performed while the spindle 8 and the chuck table 4 are rotated. For example, while the spindle 8 is rotated at 4,000 rpm and the chuck table 4 is rotated at 300 rpm, grinding feed of the grinding unit 6 is performed at 3.0 μm/s. After the predetermined area 17*d* is ground until the thickness of the ground part becomes a predetermined finish thickness 11*f*, the grinding feed is stopped. In this way, the recess 11*c* depicted in FIG. 7 is formed, and the ring-shaped reinforcement part 11*d* surrounding the recess 11*c* is formed (recess forming step S40).

Figure 7:
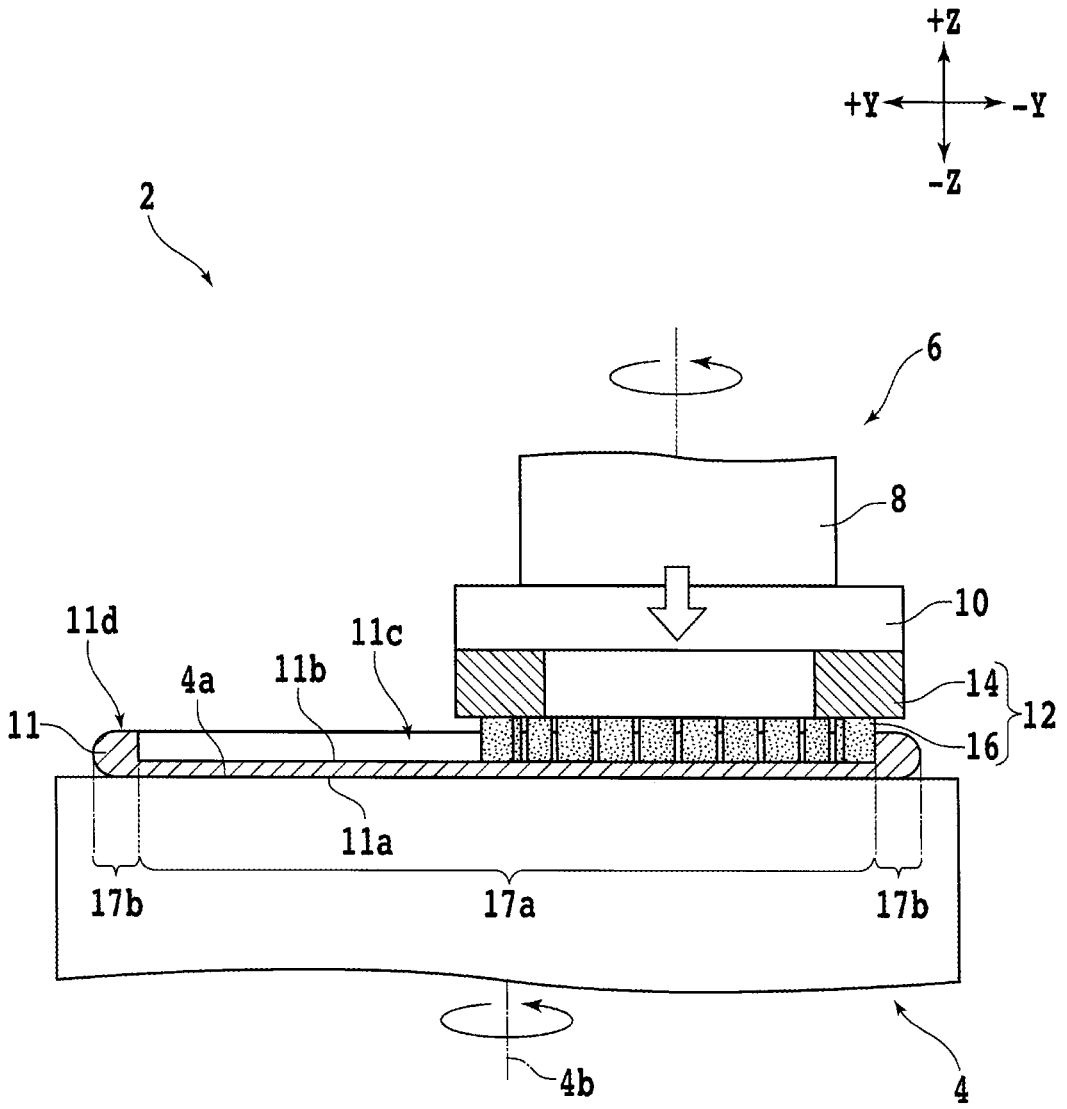
FIG. 7 is a partially sectional side view depicting a recess forming step.

FIG. 7 is a partially sectional side view depicting the recess forming step S40, and FIG. 8 is a sectional view of the workpiece 11 that has been ground. In the recess forming step S40, grinding is mainly conducted by the bottom surfaces of the grindstones 16, and, particularly, grinding can be performed in a state in which the degree of worsening of the condition of the bottom surfaces of the grindstones 16 is reduced. Therefore, even in a case where a comparatively hard oxide film is formed on the back surface 11*b* side, occurrence of grinding faults of the workpiece 11 can be restrained.

Figure 9:
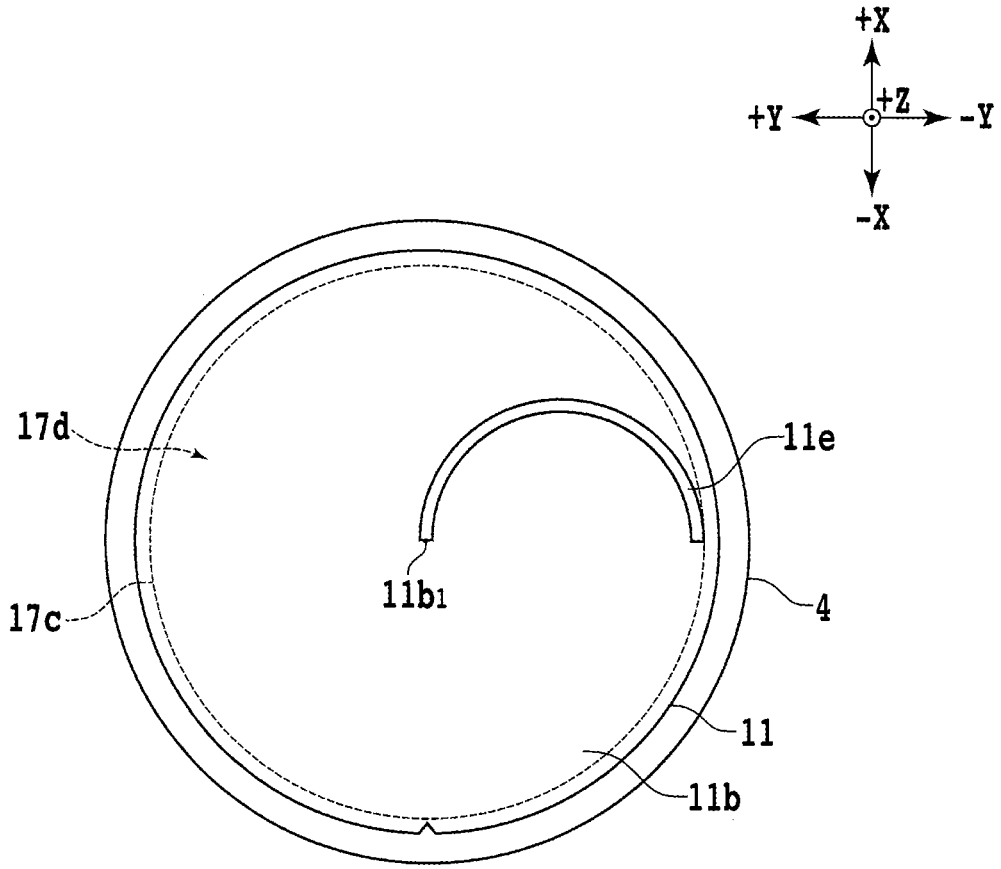
FIG. 9 is a top plan view of the workpiece depicting a groove formed in a groove forming step of a second embodiment.

Next, a second embodiment will be described. Also in the second embodiment, the holding step S10 to the recess forming step S40 are sequentially conducted in this order. It is to be noted, however, that since the inclination of the rotational axis 4*b* of the chuck table 4 in the second embodiment is greater than the inclination of the rotational axis 4*b* in the first embodiment, the position of the peripheral end portion on the +X direction side of the holding surface 4*a* is high as compared to that of the first embodiment. Therefore, in the groove forming step S20 in the second embodiment, on a +X direction side of the back surface 11*b*, not an annular shape but a semi-arcuate groove 11*e* that passes through the center $\mathbf{11}b_1$ is formed. FIG. 9 is a top plan view of the workpiece 11 depicting the semi-arcuate groove 11*e* formed in the groove forming step S20 in the second embodiment.

In the second embodiment, the semi-arcuate groove 11*e* is formed in the groove forming step S20, unlike the first embodiment, but also in the second embodiment, the groove removing step S30 and the recess forming step S40 can be performed similarly to the first embodiment. Note that the shape of the groove 11*e* formed in the groove forming step S20 of the second embodiment may be an arcuate shape having a predetermined center angle. In the groove forming step S20 of the second embodiment, by formation of the arcuate or semi-arcuate groove 11*e*, a load to the bottom surfaces of the grindstones 16 can be reduced as compared to the case of formation of an annular groove 11*e*.

Also in the groove removing step S30 of the second embodiment, as compared mainly to the case of grinding the whole on the back surface 11*b* side by the bottom surfaces of the grindstones 16, worsening of the condition of the bottom surfaces of the grindstones 16 (that is, lowering in grinding capability) can be reduced. In addition, also in the recess forming step S40 of the second embodiment, grinding can be performed in a state in which the degree of worsening of the condition of the bottom surfaces of the grindstones 16 is reduced. Therefore, even in a case where a comparatively hard oxide film is formed on the back surface 11*b* side, occurrence of grinding faults of the workpiece 11 can be restrained.

Note that the structures, methods, and the like according to the first and second embodiments can be appropriately modified in carrying out the present invention insofar as the modifications do not depart from the scope of the object of the invention.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A workpiece grinding method of grinding a workpiece by use of a grinding apparatus, the grinding apparatus including a chuck table that holds the workpiece and a grinding unit that includes a spindle and, in a state in which a grinding wheel having a plurality of grindstones disposed in an annular pattern is mounted to the spindle and is rotated around the spindle, grinds the workpiece held on the chuck table, the workpiece having, on a front surface side thereof, a device area in which a plurality of devices are formed and a peripheral marginal area surrounding the device area, the grinding method grinding a predetermined area on a back surface side of the workpiece, the predetermined area corresponding to the device area, by the grinding wheel and forming a disk-shaped recess and a ring-shaped reinforcement part surrounding the recess, the grinding method comprising:

a groove forming step of performing grinding feed of the grinding unit while the spindle is rotated, and grinding the predetermined area, in a state in which the chuck table holding the workpiece is not rotated, thereby forming an arcuate or annular groove having a depth not reaching a finished thickness on the back surface side of the workpiece;

a groove removing step of starting rotation of the chuck table while the spindle is kept rotating, thereby grinding side walls of the groove and removing the groove from the workpiece, after the groove forming step; and a recess forming step of performing grinding feed of the grinding unit while the spindle and the chuck table are rotated, thereby grinding the predetermined area that corresponds to the device area and forming the recess and the ring-shaped reinforcement part surrounding the recess, after the groove removing step.

2. The workpiece grinding method according to claim 1, wherein, in the groove removing step, the chuck table is rotated while grinding feed of the grinding unit is performed.

* * * * *